United States Patent [19]

Nero

[11] Patent Number: 4,825,129

[45] Date of Patent: Apr. 25, 1989

[54] CRT FOCUS TRACKING ARRANGEMENT

[75] Inventor: Leroy W. Nero, Indianapolis, Ind.

[73] Assignee: RCA Licensing Corporation, Princeton, N.J.

[21] Appl. No.: 115,547

[22] Filed: Oct. 29, 1987

Related U.S. Application Data

[63] Continuation of Ser. No. 730,131, May 3, 1985, abandoned.

[51] Int. Cl.[4] ..... H01J 29/70

[52] U.S. Cl. ..... 315/278; 315/3; 315/411; 361/146

[58] Field of Search ..... 315/3, 5.34, 5.39, 278, 315/382, 411; 358/218; 336/192, 198

[56] References Cited

U.S. PATENT DOCUMENTS

| | | | |
|---|---|---|---|
| 3,813,574 | 5/1974 | Sato | 336/185 |
| 3,866,086 | 2/1975 | Miyoshi et al. | 315/411 |
| 3,886,434 | 5/1975 | Schreiner | 321/27 R |
| 4,045,707 | 8/1977 | Gernot et al. | 315/291 |
| 4,144,480 | 3/1979 | Nagasaki et al. | 315/411 |
| 4,183,002 | 1/1980 | Haslau | 336/198 |
| 4,334,206 | 6/1982 | Nakamura | 336/96 |
| 4,414,578 | 11/1983 | Takeichi | 358/243 |
| 4,549,216 | 10/1985 | Yuki | 315/411 |

FOREIGN PATENT DOCUMENTS 3122589 1/1983 Fed. Rep. of Germany .

*Primary Examiner*—David K. Moore
*Assistant Examiner*—T. Salindong
*Attorney, Agent, or Firm*—Eugene M. Whitacre; Joseph J. Laks; Sammy S. Henig

[57] ABSTRACT

A video display apparatus includes a cathode ray tube and a high voltage transformer. The high voltage transformer incorporates a high voltage winding having a tap which provides a focus voltage for the electron gun assembly of the cathode ray tube. The transformer also includes a supply winding which provides power to the electron gun assembly drive circuit. The supply winding is wound to be closely coupled to the portion of the high voltage winding not associated with the generation of focus voltage so that increasing beam current produces nonuniform loading of the high voltage winding.

9 Claims, 3 Drawing Sheets

CRT FOCUS TRACKING ARRANGEMENT

This is a continuation of application Ser. No. 730,131, filed on May 3, 1985, now abandoned.

This invention relates to high voltage transformers for video display apparatus and, in particular, to high voltage transformers that utilize a tertiary winding to generate a focus voltage.

The electron gun assembly of a color cathode ray tube produces one or more electron beams which impinge upon a phosphor display screen in a predetermined pattern to form a scanned raster. The electron gun assembly is designed to produce a number of spatial regions of different voltage potentials through which the electron beam or beams pass. One of these voltage potential regions provide focussing of the beams so that the spots formed when the beams strike the display screen are of a desirable size and sharpness.

The focus voltage or potential may be generated by providing a tap on the high voltage or tertiary winding of the high voltage transformer. The electron gun assembly used in the COTY-29 picture tube manufactured by RCA Corporation utilizes a high voltage winding tapped to provide a focus voltage nominally equal to one-third of the high voltage or ultor potential. Changes in electron beam current, due to variations in picture brightness, may require that the focus ratio (i.e., the ratio of the focus voltage level to the high voltage level) change in order to maintain optimum beam focus. This focus tracking in which the focus voltage changes in response to variations in beam current, becomes more important for picture tubes having large deflection angles (e.g., 110°) or for picture tubes utilizing deflection yokes that provide raster distortion correction, such as pincushion correction, which may increase the amount of deflection defocussing experienced by the electron beams. As the electron beam current increases, however, the loading on the high voltage supply also increases, which may cause the high voltage level to decrease, resulting in an increase in the focus ratio. Some picture tubes, including the previously described COTY-29 picture tubes, incorporates electron gun assemblies that, in order to produce optimally focussed beams, require the focus ratio to decrease as beam current increases.

In accordance with an aspect of the present invention, a high voltage transformer for use in a video display apparatus comprises a high voltage winding having first and second terminals located at opposite ends of the winding and providing a high voltage potential. An intermediate terminal providing a focus potential is located between the first and second terminals and defines a focus winding region between the intermediate terminal and the first terminal. A supply winding is located adjacent to the high voltage winding and is magnetically coupled to the high voltage winding. The region occupied by the supply winding and the focus winding region have significant portions that do not overlap.

In the accompanying drawing.

Figure 1:
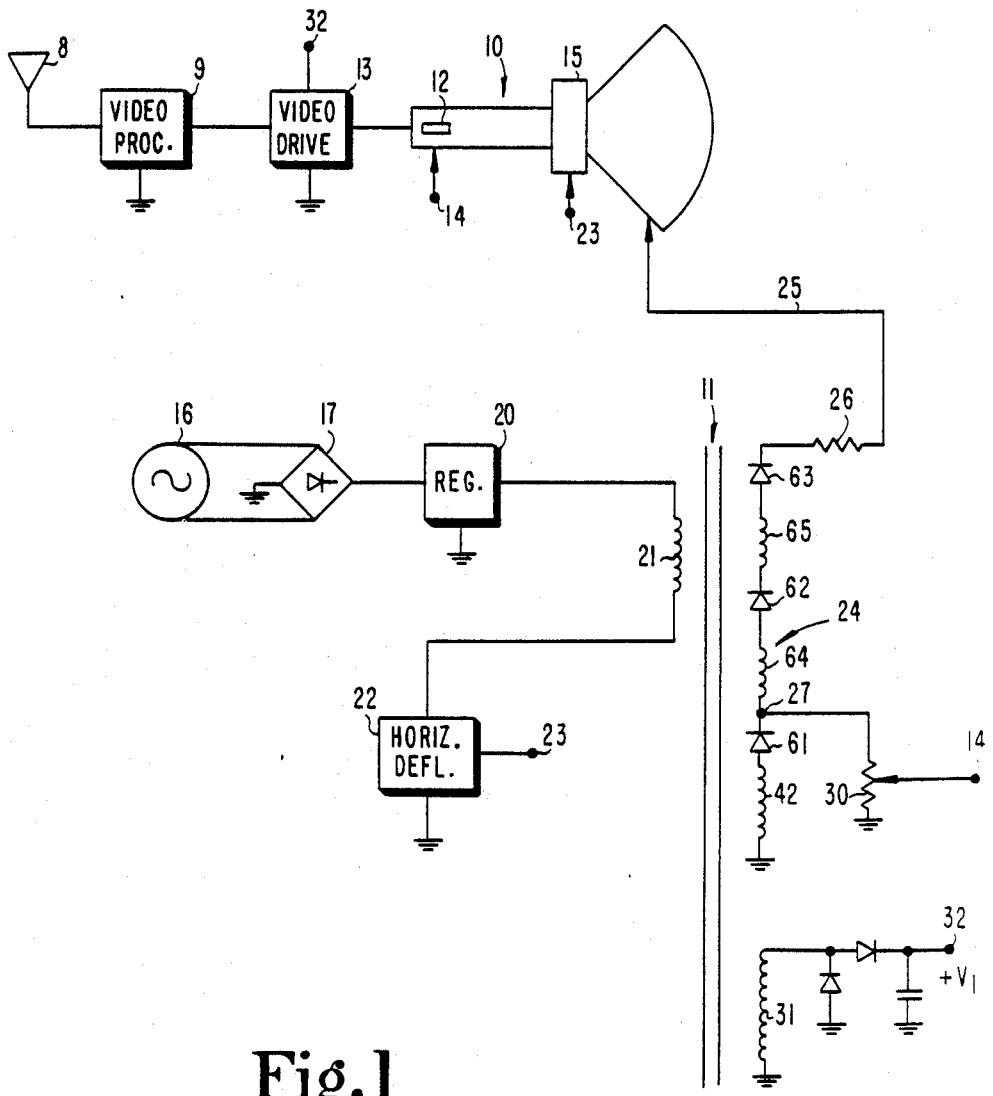
FIG. 1 is a schematic and block diagram of a portion of a video display apparatus.

Referring to FIG. 1, there is shown a portion of a video display apparatus including a cathode ray tube or picture tube 10 and a high voltage transformer 11. Video signals illustratively received via antenna 8 are applied to video processing circuitry 9, which demodulates and decodes the signal in an appropriate manner for application to video drive circuit 13. The output of video drive circuit 13 is applied to picture tube 10, which incorporates an electron gun assembly 12. Electron gun assembly 12, when energized, may illustratively produce three electron beams. Various operating voltage levels may be applied to electron gun assembly 12, including a focus voltage level via a terminal 14. The electron beams are deflected to form a scanned raster by deflection yoke 15.

A source of AC voltage 16 is coupled to a rectifying circuit 17 which produces an unregulated DC voltage level that is applied to a regulator circuit 20. Regulator 20 may illustratively be of various types, such as switched-mode or SCR regulators. The output of regulator 20 is a regulated DC voltage that is applied to one terminal of a primary winding 21 of high voltage transformer 11. The other terminal of primary winding 21 is coupled to a horizontal deflection circuit 22 which generates horizontal deflection signals that are applied to the horizontal deflection windings of deflection yoke 15 via terminal 23.

High voltage transformer 11 includes a high voltage winding 24, comprising winding segments 42, 64 and 65, and rectifying diodes 61, 62 and 63, which is energized by primary winding 21 during the horizontal retrace interval and produces a high voltage level that is applied to the anode terminal of picture tube 10 via conductor 25. Resistor 26 limits the current that can be provided by high voltage winding 24 in order to protect various electrical components of the video display apparatus. A tap 27 on high voltage winding 24 provides a focus voltage that is applied to electron gun assembly 12 via terminal 14. Tap 27 is selected so that the focus voltage is nominally of the order of one-third the high voltage level. The focus voltage generating portion of high voltage winding 24 will therefore comprise one-third of the full traverse of high voltage winding 24; i.e., one-third of the total number of winding turns of high voltage winding 24. The focus voltage is supplied from tap 27 to terminal 14 via an adjustable resistor 30.

High voltage transformer 11 also includes a load circuit supply winding 31 which, via appropriate rectifying diodes and filtering capacitors, produces a voltage level $+V_1$ at a terminal 32. Voltage level $+V_1$may illustratively be of the order of +230 volts and may be applied to video drive circuitry 13.

As the electron beam current is increased due to viewer adjustment of the brightness control or due to changes in the picture scene brightness, the focus ratio, that is, the ratio of the focus voltage level to the high voltage level, may no longer provide the same quality of beam focus or sharpness as that provided at lower beam current levels. The RCA COTY-29 picture tube, for example, experiences improved beam focus at higher beam current levels as a result of a decreasing focus ratio as beam current increases beyond, for example, 0.2 milliamperes. In a typical circuit application, however, the focus ratio will remain constant or tend to increase at higher beam current levels, due to picture tube loading of the high voltage supply circuit.

Figure 2:
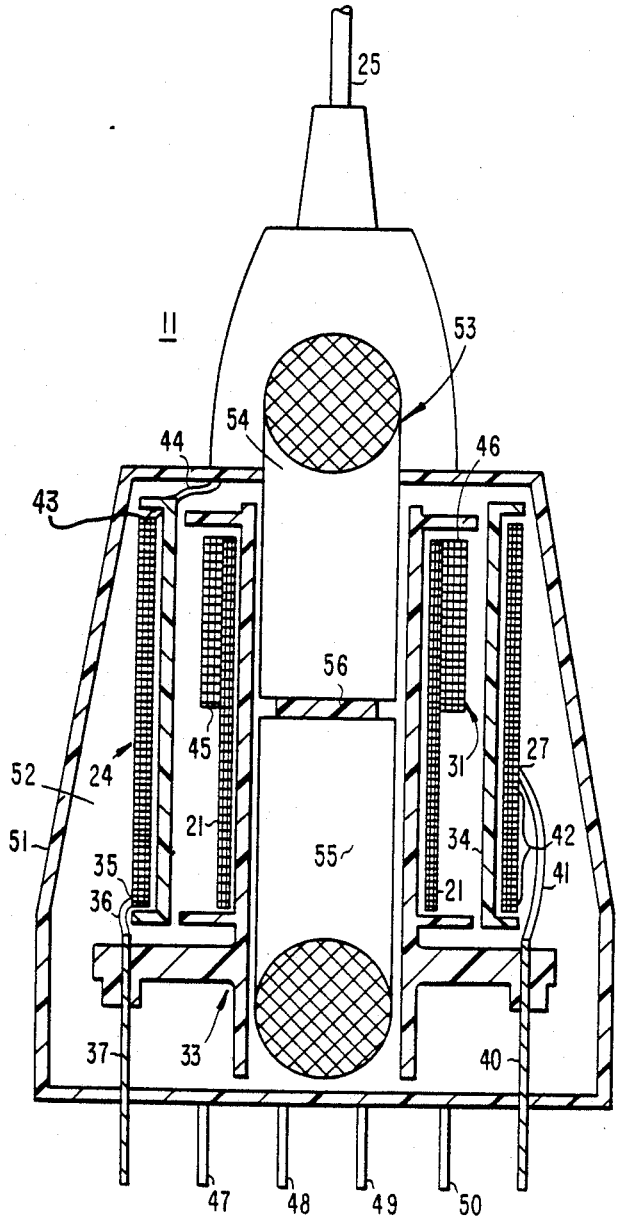
FIG. 2 is a cross-sectional view of a high voltage transformer in accordance with an aspect of the present invention.

FIG. 2 illustrates an embodiment of a high voltage transformer 11 in which supply winding 31 is wound in a manner that produces the previously described desirable decreasing focus ratio at high increasing beam current levels. Transformer 11 comprises a primary winding bobbin 33 on which is wound the transformer primary winding 21. Primary winding 21 comprises upper and lower terminals that are connected to terminal stakes 48 and 49. Primary winding 21 is wound to substantially cover the full traverse of the high voltage winding 24 to provide uniform loading of the high voltage winding 24 during the horizontal retrace interval as is described in U.S. patent application, Ser. No. 717,805, filed Mar. 29, 1985 in the name of L. W. Nero and entitled "Transformer Winding Arrangement for a Television Apparatus", herein incorporated by reference. A tertiary winding bobbin 34 surrounds the primary winding bobbin 33, and has high voltage winding 24 wound thereon. The lower terminal 35 of high voltage winding 24 is connected via a conductor 36 to a terminal stake 37. The focus-take off tap 27 is connected to terminal stake 40 via a conductor 41. In order to provide a nominal focus ratio of one-third, tap 27 is located at a distance equal to one-third of the total traverse of high voltage winding 24 from lower terminal 35, thereby forming a focus voltage generating winding region 42 as part of high voltage winding 24. The upper terminal 43 of high voltage winding 24 is connected to the cathode ray tube anode terminal conductor 25 via a conductor 44.

In accordance with an aspect of the present invention, supply winding 31, which provides power to the video drive circuitry 13, is wound on bobbin 33 and overlays primary winding 21. Supply winding 31 is wound to cover or overlay only the upper one-half of the traverse of primary winding 21 and does not overlap the focus voltage generating portion 42 of high voltage winding 24. Supply winding 31 will then be magnetically more tightly coupled to the upper portion of the traverse of high voltage winding 24 and magnetically less tightly coupled to the lower portion of the traverse of high voltage winding 24, which includes the focus voltage generating winding region 42. The lower terminal 45 and upper terminal 46 of supply winding 31 are illustratively connected to terminal stakes 47 and 50 respectively by conductors (not shown). The previously described bobbins and windings are located within a transformer housing 51. Housing 51 is filled with an epoxy compound 52 which pots the windings in a conventional manner. A magnetically permeable core 53 comprising upper and lower core segments 54 and 55, is located within the interior of primary bobbin 33. A crushable spacing material 56 separates core segments 54 and 55 to permit adjustment of the inductance of primary winding 21.

Supply winding 31 provides power to video drive circuitry 13 in order to drive the electron gun assembly 12 of cathode ray tube 10 and is consequently heavily loaded; therefore an increase in electron beam current causes an increase in loading of supply winding 31. As previously described, supply winding 31 is magnetically coupled to high voltage winding 24. This magnetic coupling causes the loading of supply winding 31 to result in a corresponding loading of high voltage winding 24. Substantial loading of high voltage winding 24 by supply winding 31 occurs, however, only in the region closely coupled to supply winding 31, i.e., that portion of high voltage winding 24 not associated with the generation of focus voltage. The primary winding generated retrace pulse appearing across the portion of high voltage winding 24 that is tightly coupled to supply winding 31 becomes flatter and broader because of the loading caused by supply winding 31. Rectifying diodes 62 and 63, shown in FIG. 1, associated with the loaded portion of winding 24, will conduct for a longer period of time than rectifying diode 61 therefore lowering the output impedance of the portion of high voltage winding 24 tightly coupled to supply winding 31. The overall loading of winding 24 due to increasing beam current will therefore cause a greater decrease in focus voltage level relative to the decrease in high voltage level, due to the lowered output impedance of the high voltage generating portion of high voltage winding 24. The focus ratio, i.e., the focus voltage level with respect to the high voltage level, will therefore decrease as the beam current increases. This results in improved electron beam focus characteristics with respect to beam current changes. The previously described winding arrangement of the primary winding with respect to the high voltage winding results in a constant degree of coupling between the primary and high voltage winding. The harmonic tuning of the transformer is not affected by changes in beam current or supply winding 31 loading. The arrangement of the present invention advantageously relies on the loading of the supply winding 31 to control the retrace pulse waveshape in a manner that results in desirable focus ratio changes in response to beam current variations.

Figure 3:
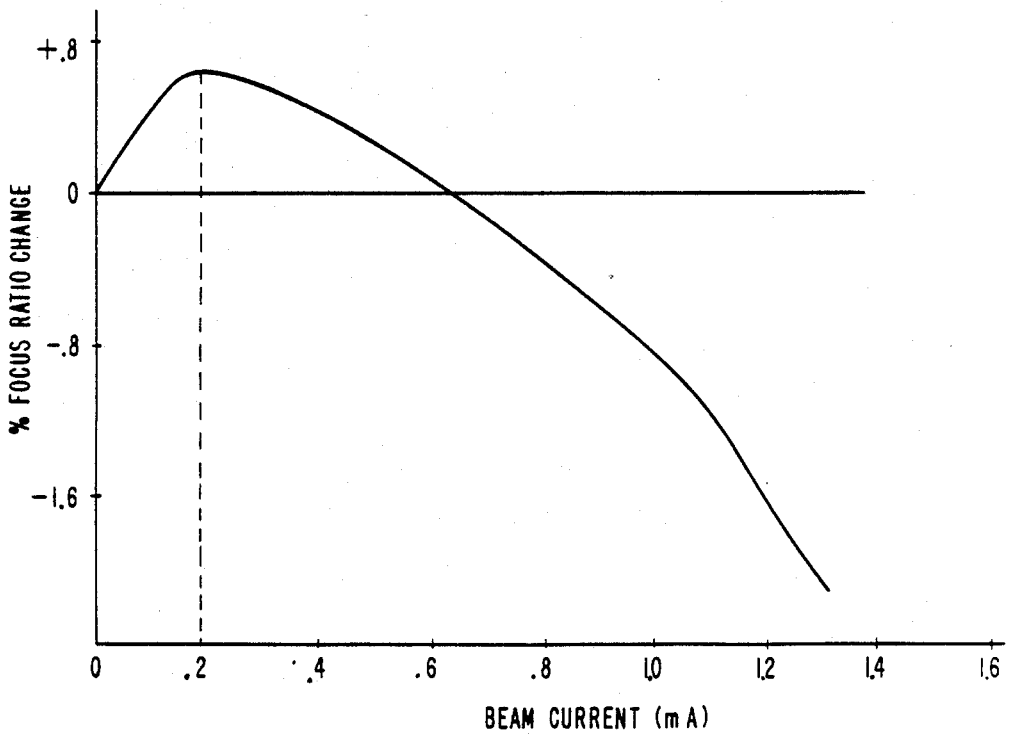
FIG. 3 is a graph illustrating a relationship inherent in the operation of the transformer shown in FIG. 1.

FIG. 3 graphically illustrates the percent change in focus ratio, with respect to a nominal ratio, associated with the use of the inventive transformer structure of FIG. 2 as a result of beam current changes. At low beam current levels, less than 0.2 milliamperes, for example, an increase in beam current results in an increase in the focus ratio. This is due to the focus bleeder resistor 30 loading the focus voltage generating portion of winding 24 and lowering the output impedance of the focus voltage generating circuit so that the high voltage level decreases relative to the focus voltage. For low beam current levels, this provides optimum focus characteristics. As the beam current increases, however, the previously described loading of the upper portion of high voltage winding predominates, resulting in a desirable decrease in focus ratio at high beam current levels.

The amount of the traverse of high voltage winding 24 that is overlaid by supply winding 31 may be selected to provide the desired change in focus ratio with respect to the beam current in order to achieve optimum electron beam focus for a given cathode ray tube and video display apparatus.

What is claimed is:

1. In a video display apparatus incorporating a cathode ray tube having an electron gun assembly, a high voltage transformer comprising:

a high voltage winding having first and second terminals located at opposite ends of said winding for defining a high voltage winding region and providing a high voltage potential at said second terminal, and an intermediate terminal located between said first and second terminals, said intermediate terminal defining a focus winding region between said intermediate terminal and said first terminal and providing a focus potential for said electron gun assembly;

a primary winding for energizing said transformer; and a supply winding, forming a secondary winding of said transformer, for energizing said electron gun assembly and being located adjacent said high voltage winding for magnetically coupling thereto, the region occupied by said supply winding and said focus winding region having substantial non-overlapping portions such that the degree of magnetic coupling between said supply winding and said focus winding region of said high voltage winding is less than the degree of magnetic coupling between said supply winding and the region of said high voltage winding defined by said intermediate terminal and said second terminal, the output impedance associated with the region of said high voltage winding being defined by said intermediate terminal and said second terminal, said output impedance being lowered as a result of increasing beam current from said electron gun to cause a greater decrease in said focus potential relative to the decrease in the high voltage potential, such that loading of said high voltage winding due to an increasing beam current causes a focus ratio of said focus potential to said high voltage potential that decreases as said beam current increases.

2. The arrangement defined in claim 1, wherein said region occupied by said supply winding is disposed relative to said high voltage winding region to provide a decrease in the ratio of said focus potential to said high voltage potential as the current provided by said high voltage winding increases above a predetermined level.

3. The arrangement defined in claim 2, wherein said predetermined current level comprises a current level of the order of 0.2 milliamperes.

4. The arrangement defined in claim 3, further comprising a focus voltage generating output circuit coupled to said intermediate terminal, said output circuit providing an increase in the ratio of said focus potential to said high voltage potential as sais current provided by said high voltage winding increases while said current is below said predetermined level.

5. The arrangement defined in claim 1, wherein said supply winding provides current to a load circuit, the level of current provided determined by the level of current provided by said high voltage winding to said cathode ray tube.

6. The arrangement defined in claim 1, wherein said supply winding provides power to a drive circuit of said electron gun assembly.

7. A high voltage transformer for use in a video display apparatus comprising:

a high voltage winding having first and second terminals located at opposite ends of said high voltage winding and providing a high voltage potential at said second terminal, and having an intermediate terminal defining a focus potential generating region between said intermediate terminal and said first terminal and a high voltage generating region between said intermediate terminal and said second terminal, said intermediate terminal providing a focus potential;

a primary winding for energizing said high voltage winding located to substantially substantially completely occupy a substantial region between said first and second terminals of said high voltage winding such that said high voltage winding is substantially uniformly energized by said primary winding; and a supply winding energized by said primary winding and being located adjacent to said high voltage winding for magnetic coupling thereto, said supply winding occupying a region that has substantially no overlap with said focus potential generating region such that the degree of magnetic coupling between said supply winding and said focus potential generating region is less than the degree of magnetic coupling between said supply winding and said high voltage generating region, the output impedance associated with the region of said high voltage winding being defined by said terminal and said second terminal, said output impedance being lowered as a result of increasing beam current from said electron gun to cause a greater decrease in said focus potential relative to the decrease in the high voltage potential, such that loading of said high voltage winding to an increasing beam current causes a focus ratio of said focus potential to said high voltage potential that decreases as said beam current increases.

8. In a video display apparatus incorporating a cathode ray tube having an electron gun assembly, a high voltage transformer comprising:

high voltage winding providing a high voltage potential;

a primary winding for energizing said transformer; and a supply winding, forming a secondary winding of said transformer, for energizing said electron gun assembly and being located adjacent said high voltage winding for magnetically coupling thereto, the region occupied by said supply winding and the region occupied by said focus winding having substantial non-overlapping portions such that the degree of magnetic coupling between said supply winding and said focus winding is less than the degree of magnetic coupling between said supply winding and said high voltage winding, the output impedance associated with the region of said high voltage winding being defined by said intermediate terminal and said second terminal, said output impedance being lowered as a result of inreasing beam current from said electron gun to cause a greater decrease in said focus potential relative to the decrease in the high voltage potential, such that loading of said high voltage winding due to an increasing beam current causes a focus ratio of said focus potential to said high voltage potential that decreases as said beam current increases.

9. A high voltage transformer according to claim 1 wherein said primary winding overlaps at least a substantial portion of each of said regions of said high voltage winding for obtaining a substantial constant degree of coupling between said primary winding and each of said regions of said high voltage winding.

* * * * *